US007451524B2

(12) United States Patent
Sattler

(10) Patent No.: US 7,451,524 B2
(45) Date of Patent: Nov. 18, 2008

(54) SIDE HANDLE FOR A HAND-HELD POWER TOOL

(75) Inventor: Christian Sattler, Biessenhofen (DE)

(73) Assignee: Hilti Aktiengesellschaft, Schaan (LI)

( * ) Notice: Subject to any disclaimer, the term of this patent is extended or adjusted under 35 U.S.C. 154(b) by 219 days.

(21) Appl. No.: 11/300,112

(22) Filed: Dec. 13, 2005

(65) Prior Publication Data

US 2006/0130279 A1 Jun. 22, 2006

(30) Foreign Application Priority Data

Dec. 21, 2004 (DE) ..... 10 2004 061 522

(51) Int. Cl.
*B25G 1/10* (2006.01)

(52) U.S. Cl. ..... 16/421; 16/426; 16/422; 16/436

(58) Field of Classification Search ..... 16/422, 16/421, 426, 436, DIG. 40, DIG. 41; 294/49; 173/213, 216, 217; 409/182, 181; 408/124; 81/177.1, 177.4, 177.85, 489, 490
See application file for complete search history.

(56) References Cited

U.S. PATENT DOCUMENTS 2,019,052 A * 10/1935 Lord ..... 267/140.3
4,368,556 A * 1/1983 Wanner et al. ..... 16/436
4,420,989 A * 12/1983 Finkle ..... 74/551.2
5,269,045 A * 12/1993 DeSerio et al. ..... 16/422
5,769,174 A * 6/1998 Lee et al. ..... 173/162.2
6,241,594 B1 * 6/2001 Lepold ..... 451/359
6,863,479 B2 * 3/2005 Frauhammer et al. ... 408/241 R
2001/0011846 A1 * 8/2001 Krondorfer et al. ..... 310/17
2002/0197939 A1 * 12/2002 Frauhammer et al. ..... 451/64
2003/0132016 A1 * 7/2003 Meixner et al. ..... 173/162.2
2005/0034276 A1 * 2/2005 Badiali ..... 16/426
2005/0217440 A1 * 10/2005 Koschel et al. ..... 81/490

FOREIGN PATENT DOCUMENTS

DE 10130548 A1 1/2003
JP 02076612 A * 3/1990

* cited by examiner

*Primary Examiner*—Chuck Y. Mah
(74) *Attorney, Agent, or Firm*—Abelman, Frayne & Schwab

(57) ABSTRACT

A side handle (2) for a hand-held power tool, such as, e.g., hammer drill or chisel hammer, includes a handle holder (10), an attachment device (6) for securing the side handle (2) on the power tool (4), and a decoupling device (8) for connecting the handle holder (10) with the attachment device (6) and for guiding the handle holder (10) relative to the attachment device (6), with the decoupling device (8) having two, spaced from each other, swinging elements deflectable parallel to each other.

5 Claims, 2 Drawing Sheets

SIDE HANDLE FOR A HAND-HELD POWER TOOL

BACKGROUND OF THE INVENTION

1. Field of the Invention

The present invention relates to a side handle for a hand-held power tool such as a hammer drill or a chisel hammer.

2. Description of the Prior Art

A side handle for a hand-held power tool has a handle holder that the user can grasp to comfortably hold the side handle or the power tool. The side handle further has an attachment device for being releasably or permanently secured on the power tool. The handle holder and the attachment device are connected with a decoupling device that partially vibration decouples the handle holder from the attachment device. The decoupling device stably guides the handle holder relative to the attachment device, i.e., the handle holder retains its alignment with respect to the attachment device upon being guided relative thereto.

The advantage of such a side handle consists in that the decoupling takes place in a predetermined direction while a relatively stable guidance with respect to other directions is insured. Thereby, despite a significantly reduced vibration acting on the handle holder, a reliable feeling of the power tool is conveyed to the user during guidance of the power tool.

German Publication DE 101 30 548 discloses an additional handle for a hand-held power toll the handle holder of which is translationally displaced parallel to the operational direction of the power tool over its support unit.

The drawback of the additional or side handle of DE 101 30 548 consists in that the support unit for translational displacement of the handle holder has a very costly and bulky construction.

Accordingly, an object of the present invention is a side handle in which the drawbacks of the prior art handle are eliminated.

Another object of the present invention is a side handle having reduced manufacturing costs and is comfortably handled.

SUMMARY OF THE INVENTION

These and other objects of the present invention, which will become apparent hereinafter, are achieved by providing a handle that includes a decoupling device for connecting the handle holder with the attachment device with a partial vibration decoupling of the handle holder from the attachment device, and for stably guiding of the handle holder relative to the attachment device. The decoupling device has two, spaced from each other, swinging elements deflectable parallel to each other.

The decoupling device according to the present invention insures a constructively simple decoupling of the handle holder from the attachment device, while the swinging elements of the decoupling device, which are deflected parallel to each other, provide for a reliable guidance of the handle holder In addition, during a forceful displacement of the handle holder by the swinging elements relative to the attachment device, the handle holder retains the same alignment relative to the attachment device or to the power tool. This insures a stable guidance of the power tool, together with a substantially reduced transmission of vibrations to the handle holder. The decoupling device according to the present invention can be made very compact so that it can be easily integrated into the side handle. During an operation of the power tool, no hindrance to the operation, e.g., as a result of tilting of the decoupling device, occurs. All in all, there is provided a side handle having small manufacturing costs and which insures, at the same time, a comfortable handling of the power tool during the operation of the power tool.

Advantageously, the attachment device includes a strap retainer that defines a receiving axis for the power tool. The swinging elements of the decoupling device extend perpendicular to the receiving axis. Thereby, a decoupling for a number of power tools, in particular such as hammer drills and chisel hammers, can be achieved, in particular exactly in the direction of the main vibration axis of the power tool. This insures a substantial reduction of vibrations that are applied to the handle holder.

Advantageously, the decoupling device is secured with respect to the receiving axis with locating means. The locating means exactly defines the direction in which the decoupling device decouples the handle holder from the attachment device to a most possible extent, and insures that this direction is reliably retained during the entire time of the operation of the power tool.

According to a particularly advantageous embodiment of the present invention, the swinging elements are formed by opposite walls of a four-side spring member that forms part of the decoupling device. Thereby, both swinging elements are formed by a single common spring member. Thereby, a particularly precise parallel kinematics can be achieved upon deflection of the swinging elements. In addition, a single common spring member provides for a particularly simple and cost-effective manufacturing of the decoupling device.

It is beneficial when the spring member is formed as a bent leaf spring, which provides for a particularly simple manufacturing of the spring member. In addition, with a leaf spring, a particularly favorable pliability of the spring member is achieved, which permits to optimize the decoupling of the handle holder and, thereby, to increase the operating convenience.

Advantageously, the leaf spring is formed of a spring steel, which provides for a particular stable decoupling device that retains substantially the same deformation characteristics over its service life. Thereby, a lasting comfortable reduction of vibrations, which act on the handle holder, is achieved.

Advantageously, the spring member has two ends forming an overlapping region between the two opposite walls that forms the swinging elements. With formation of the overlapping region, the decoupling device can be produced in a particularly simple manner by simply bending the spring member. The final securing of both ends of the spring member to each other can be achieved upon attachment of the overlapping region to the attachment device.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
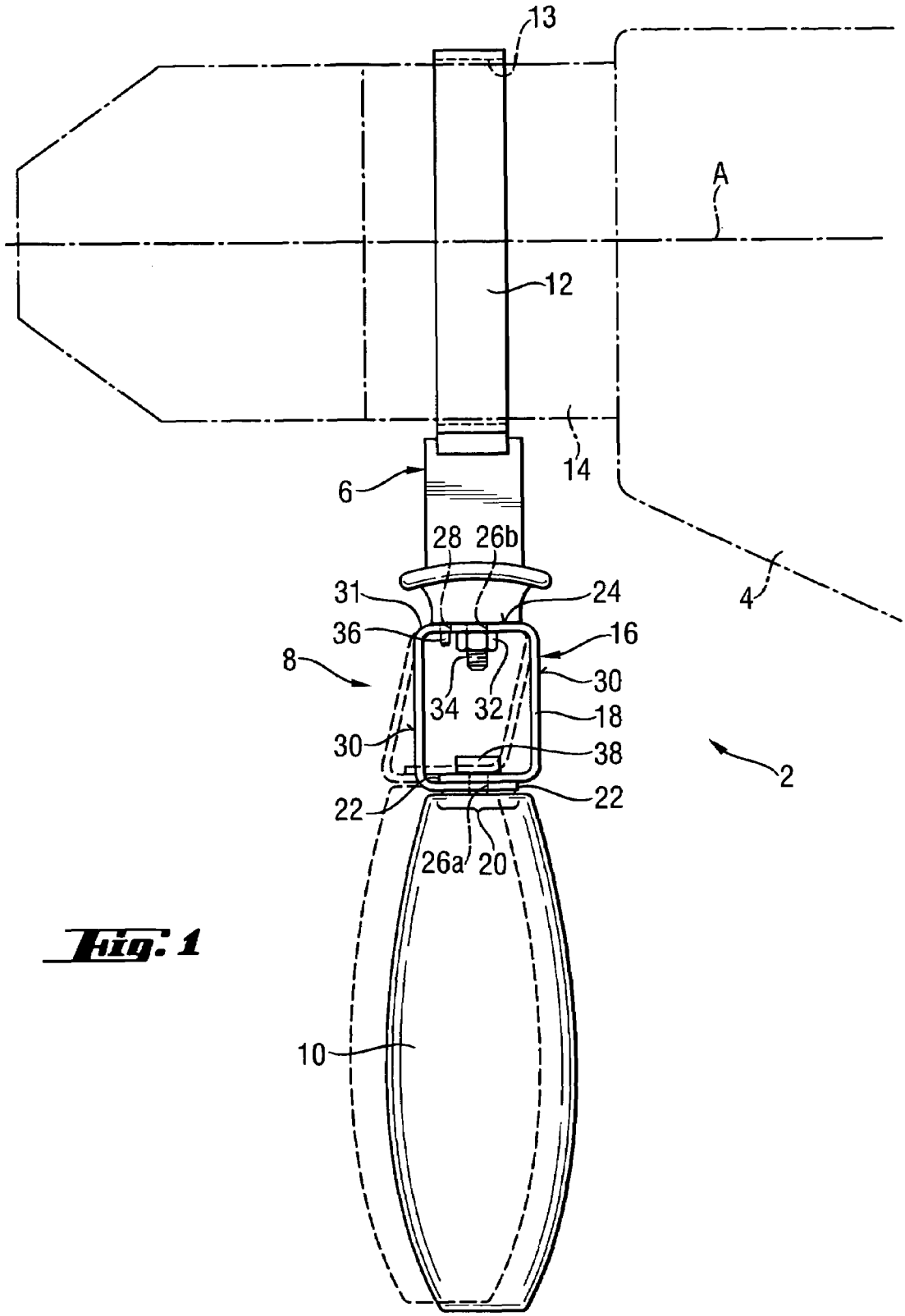
FIG. 1 a side view of a side handle according to the present invention, together with an attachment device.

FIG. 1 shows a side handle 2 according to the present invention that is attached to a schematically shown, with dot-dash lines, hand-held power tool 4, such as, e.g., a hammer drill or a chisel hammer. Alternatively, the side handle 2 can be attached to an electrical scroll saw or a grinding tool.

The attachment handle 2 essentially includes an attachment device 6 that is connected to the holder 10 with a decoupling device 8.

The attachment device 6 has a strap retainer 12. The strap retainer 12 forms an opening 13 the central axis of which defines a receiving axis A along which a neck 14 of the power tool 4 is inserted in the strip retainer 12. The strap retainer 12 is tightened on the power tool neck 14 with a locking device, not shown, for releasably mounting the side handle 2 on the power tool neck 14. In a tightening condition of the strap retainer 12, the receiving axis A of the attachment device 6 coincides with an operational axis of the power tool 4 along which impact, reciprocating, or rotational movement of the power tool 4 is effected.

Figure 2:
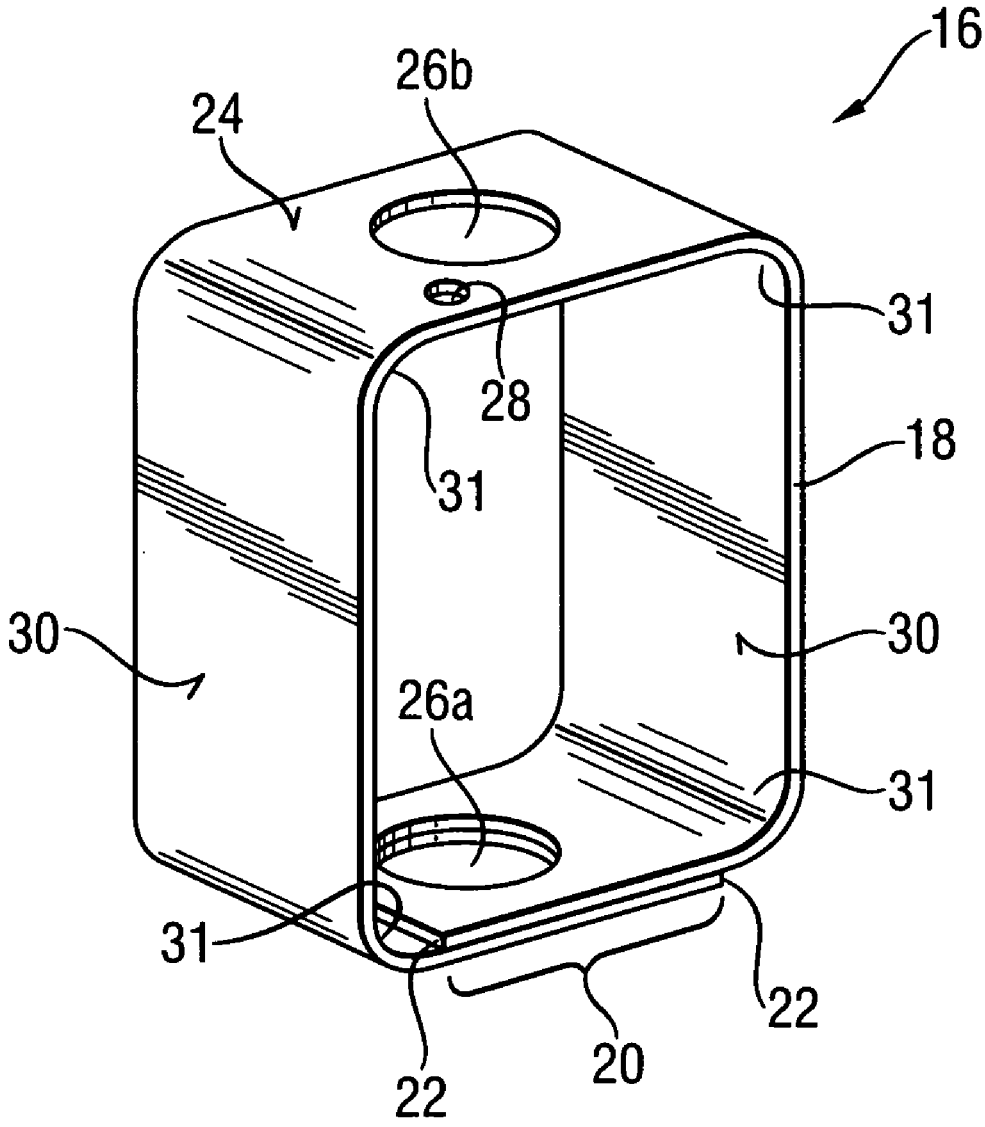
FIG. 2 a perspective view of the spring member of the side handle shown in FIG. 1.

The decoupling device 8 has a spring member 16 that, as shown in FIG. 2, is formed as a leaf spring 18 which is so bent that it forms a four-side profile with an overlapping region 20 of both ends 22. The leaf spring 18 is formed of a spring steel. Alternatively, the leaf spring 18 can be formed of a springy plastic material.

The overlapping region 20 and the opposite end wall 24 of the spring member 16 have each an attachment bore 26*a*, 26*b*. In addition, the end wall 24 has a locating bore 28.

Between the overlapping region 20 and the opposite end wall 24, the leaf spring 18 has two walls 30 extending parallel to each other and spaced from each other. The walls 30 are connected with the overlapping region 20 and the opposite thereto, end wall 24 by rounded corner regions 31. Due to the springy material the leaf spring 18 is made of, the walls 30 function as deflectable parallel to each other, swinging elements.

As shown in FIG. 1, the spring member 16 is screwed on a threaded rod 34 of the attachment device 6 with a nut 32, with the threaded rod 34 extending through the attachment bore 26*b* in the end wall 24. For a precise alignment of the spring member 16 relative to the attachment device 6, a locating pin 36 projects from the attachment device 6, extending parallel to the treaded rod 34. Upon mounting of the spring member 16 on the attachment device 6, the locating pin 36 engages in the locating bore 28 in the end wall 24. The locating pin 36 and the locating bore 28 thus function as locating means with which the spring member 16 is so aligned with the attachment device 6 that the side wall 30 of the spring member 16 extend precisely perpendicular to the receiving axis A. In this position, the walls 30 are arranged precisely one after another in the direction of the receiving axis A.

Attachment means 38 connects the holder 10 with the spring member 16. The attachment means 38 extends through the attachment bore 26*a* in the overlapping region 20, securing the both ends 22 of the leaf spring 18 to each other.

During an operation, the holder 10 can displace relative to the attachment device 6 or to the power tool 4, as shown with dash lines. The holder 10 is forcefully guided or displaced by the walls 30 of the spring member 16 which function as swing elements. During the swinging movement, at all times, the walls 30 remain parallel to each other. Thereby the holder 10 constantly extends perpendicular to the receiving axis A, being displaceable parallel to itself.

Thereby, the holder 10 is decoupled to a most possible extent in the direction of the receiving axis A from vibrations that occur during the operation of the power tool 4. In other directions, the guidance with the holder 10 remains stable.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A side handle (2) for a hand-held power tool (4), comprising:

a handle holder (10);

an attachment device (6) for securing the side handle (2) on the power tool (4); and a decoupling device (8) positioned between the handle holder (10) and the attachment device (6) for connecting the handle holder (10) with the attachment device (6) through the decoupling device (8), wherein the decoupling device (8) responds to vibrations of the power tool (4) to permit swinging movement and displacement of the handle holder (10) independent of the attachment device (6), and for stably guiding the handle holder (10) relative to the attachment device (6), the decoupling device (8) having a one-piece four-sided spring member (16) formed from a bent leaf spring (18) and having opposite walls (30) that form two swinging elements spaced from each other and deflectable parallel to each other to permit the swinging movement and displacement of the handle holder (10).

2. A side handle according to claim 1, wherein the attachment device (6) comprises a strap retainer (12) that defines a receiving axis (A) for the power tool (4), and wherein the swinging elements of the decoupling device (8) extend perpendicular to the receiving axis (A).

3. A side handle according to claim 2, further comprising locating means (28, 36) for positioning of the decoupling device (8) relative to the receiving axis (A).

4. A side handle according to claim 1, wherein the leaf spring (18) is formed of a spring steel.

5. A side handle according to claim 1, wherein the spring member (16) has two ends (22) forming an overlapping region between the two swinging elements of the spring member (16).

* * * * *